US007726061B1

(12) United States Patent
Thummel

(10) Patent No.: US 7,726,061 B1
(45) Date of Patent: Jun. 1, 2010

(54) DUAL BEAM LASER MODULE

(75) Inventor: Heinz F. Thummel, Corral de Tierra, CA (US)

(73) Assignee: Laser Devices, Inc., Monterey, CA (US)

( * ) Notice: Subject to any disclaimer, the term of this patent is extended or adjusted under 35 U.S.C. 154(b) by 1274 days.

(21) Appl. No.: 10/802,115

(22) Filed: Mar. 13, 2004

(51) Int. Cl.
*F41G 1/35* (2006.01)

(52) U.S. Cl. ..... 42/115; 42/117

(58) Field of Classification Search ..... 42/114, 42/115, 116, 117, 141, 142, 146
See application file for complete search history.

(56) References Cited

U.S. PATENT DOCUMENTS 5,375,362 A * 12/1994 McGarry et al. ..... 42/117
5,531,040 A * 7/1996 Moore ..... 42/115
5,822,905 A * 10/1998 Teetzel ..... 42/117

* cited by examiner

*Primary Examiner*—Stephen M Johnson
(74) *Attorney, Agent, or Firm*—Gunnison, McKay & Hodgson, L.L.P.; Philip McKay

(57) ABSTRACT

A dual beam laser aiming module for a firearm has a dual-laser alignment housing with a first IR laser assembly in a first cavity and that provides a first beam axis. A second visible laser assembly is adjustably located in a second cavity to provide a second beam having an axis parallel to the first beam axis. A housing for the dual-laser alignment housing is adapted to be fixed to the firearm. The dual-laser alignment housing has a rounded exterior surface that interfaces with a corresponding rounded surface in the interior of the cavity of the laser housing. The dual-laser alignment housing is adjustably pivoted with respect to the laser housing with a four-point laser alignment mechanism to align the parallel first and second axes further in parallel to a centerline of a barrel of the firearm.

23 Claims, 7 Drawing Sheets

DUAL BEAM LASER MODULE

BACKGROUND OF THE INVENTION

1. Field of the Invention

This invention relates to laser aiming and alignment devices and, more particularly, to a dual beam laser aiming device for a firearm.

2. Prior Art

Previously, laser aiming modules have been provided that include only one laser device that was adjusted to align a single laser beam with the axis of a gun barrel of a firearm. Such single-laser systems are disclosed, for example, in a U.S. Pat. No. 5,581,898 entitled "Modular Sighting Laser For A Firearm" and was granted to Heinz Thummel, the inventor of the present invention. A laser alignment device is disclosed in U.S. Pat. No. 6,295,753 entitled "Laser Precision Bore Sight Assembly" and also granted to Heinz Thummel, the inventor of the present invention. Using a number of similar techniques to provide parallel alignment of two or more laser beams would produce large, bulky devices that would be impractical. Consequently, what is needed is a technique for efficiently providing a dual-beam laser aiming device.

SUMMARY OF THE INVENTION

It is therefore an object of the invention to provide a dual-beam laser aiming module that provides two laser aiming devices in a single module that is mounted to small arms.

In accordance with this and other objects of the invention, a dual beam laser aiming module for a firearm is provided according to the invention. The aiming module includes a dual-laser alignment housing having a first cavity and a second cavity formed therein. In the first cavity is fixed a first laser assembly that has a first beam axis. In the second is a second laser assembly that has a second beam axis and that is adjustably located in the second cavity to provide the second beam axis parallel to the first beam axis.

A laser housing is adapted to be fixed to the firearm and the laser housing has a cavity formed therein for receiving the dual-laser alignment housing. The dual-laser alignment housing has a rounded exterior surface that interfaces with a corresponding rounded surface in the interior of the cavity of the laser housing. Adjustment means are provided for adjustably pivoting the dual-laser alignment housing with respect to the laser housing to thereby align the parallel first and second axes further in parallel to a centerline of a barrel of the firearm.

The first laser assembly provides an infrared (IR) beam. The second laser assembly provides a visible beam.

The adjustment means includes a four-point laser alignment mechanism for adjustably pivoting the dual-laser alignment housing with respect to the laser housing to align the parallel first and second axes parallel to the centerline of the barrel of the firearm.

The four-point laser alignment mechanism includes: a first adjustment screw, an end of which contacts the dual-laser alignment housing and which is aligned for movement in a first direction perpendicular to the centerline of the gun barrel; a second adjustment screw, an end of which contacts the dual-laser alignment housing and which is aligned for movement in a second direction perpendicular to the centerline of the gun barrel and orthogonal to the first direction of the first adjustment screw; and two springloaded bushings that bias the dual-laser alignment housing against a respective end of the first and the second adjustment screws.

The dual-laser alignment housing has an external step in which fits an O-ring such that unthreaded side surfaces near the ends of the first and second adjustment screws and side surfaces of the spring-loaded bushings all contact and compress the O-ring to stabilize the position of the dual-laser alignment housing and to attenuate longitudinal movement of the dual-beam alignment housing in the direction of the beam axes.

The first laser assembly is press-fit into the first cavity. The second laser assembly is adjusted to a fixed position in the second cavity with an adhesive material such that the axis of the second beam is fixed to be parallel to the axis of the first beam.

The dual-laser alignment housing has a rounded exterior surface that interfaces with a corresponding rounded surface in the interior of the cavity of the laser housing.

The laser housing includes a LED IR illuminator adapted for use with night vision goggles.

A toggle switch is mounted to the laser housing for selecting exclusive operation of either the first laser assembly or of the second laser assembly.

The laser housing is adapted to be attached to the barrel of a particular firearm with a corresponding mounting base for the laser housing.

The laser housing has a tactical flashlight assembly mounted thereto to provide a multi-operational laser aiming module having both laser and flashlight capabilities.

A rotary switch is mounted to the laser housing for selecting operation selected from the group consisting of: no operation, a tactical light only, the tactical light and a laser only, and a laser only.

A method of aiming a firearm is provided that includes the steps of: providing a dual-laser alignment housing having a first cavity and a second cavity formed therein; fixing a first laser assembly that has a first beam axis in the first cavity; adjusting and fixing a second laser assembly that has a second beam axis in the second cavity and providing the second beam axis parallel to the first beam axis; providing a cavity in a laser housing for receiving the dual-laser alignment housing and adapting the laser housing to be fixed to the firearm; providing the dual-laser alignment housing with a rounded exterior surface and interfacing that rounded exterior surface with a corresponding rounded surface in the interior of the cavity of the laser housing; and adjustably pivoting the dual-laser alignment housing with respect to the laser housing for aligning the parallel first and second axes further in parallel to a centerline of a barrel of the firearm.

The step of adjusting and fixing the second laser assembly that has a second beam axis in the second cavity and providing the second beam axis parallel to the first beam axis includes adjustably pivoting the dual-laser alignment housing with respect to the laser housing and aligning the parallel first and second axes parallel to the centerline of the barrel of the firearm with a four-point laser alignment mechanism.

The step of adjustably pivoting the dual-laser alignment housing with respect to the laser housing and aligning the parallel first and second axes parallel to the centerline of the barrel of the firearm with a four-point laser alignment mechanism includes: contacting the dual-laser alignment housing with an end of a first adjustment screw, an end of which contacts the dual-laser alignment housing and which is aligned for movement in a first direction perpendicular to the centerline of the gun barrel; contacting the dual-laser alignment housing with an end of a second adjustment screw, an end of which contacts the dual-laser alignment housing and which is aligned for movement in a second perpendicular to the centerline of the gun barrel and orthogonal to the first direction of the first adjustment screw; and biasing the dual-laser alignment housing against a respective end of the first and the second adjustment screws with two respective spring-loaded bushings.

The method further includes the step of fitting an O-ring to an external step in which fits an O-ring, contacting the O-ring with respective unthreaded side surfaces near the ends of the first and second adjustment screws and side surfaces of the spring-loaded bushings, and compressing the O-ring to stabilize the position of the dual-laser alignment housing in order to attenuate longitudinal movement of the dual-beam alignment housing in the direction of the beam axes.

The method includes press-fitting the first laser assembly into the first cavity; and adjusting and fixing the second laser assembly to a fixed position in the second cavity with an adhesive material such that the axis of the second beam is fixed to be parallel to the axis of the first beam.

The method includes interfacing a rounded exterior surface of the dual-laser alignment housing with a corresponding rounded surface in the interior of the cavity of the laser housing.

The method includes illuminating an area with a LED IR illuminator adapted for use with night vision goggles.

The method includes exclusively operating either the first laser assembly or the second laser assembly with a toggle switch mounted to the laser housing.

The method includes the step of attaching the barrel of a particular firearm with a corresponding mounting base for the laser housing.

The method includes the step of mounting a tactical flashlight to the laser housing to provide a multi-operational laser aiming module having both laser and flashlight capabilities.

The method includes selecting with a rotary switch mounted to the laser housing an operation selected from the group consisting of: no operation, a tactical light only, the tactical light and a laser only, and a laser only.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Reference is now made in detail to a preferred embodiment of the invention, an example of which is illustrated in the accompanying drawings. While the invention is described in conjunction with the preferred embodiment, it will be understood that it is not intended to limit the invention to this embodiment. On the contrary, the invention is intended to cover alternatives, modifications and equivalents, which may be included within the spirit and scope of the invention as defined by the appended claims.

Figure 1:
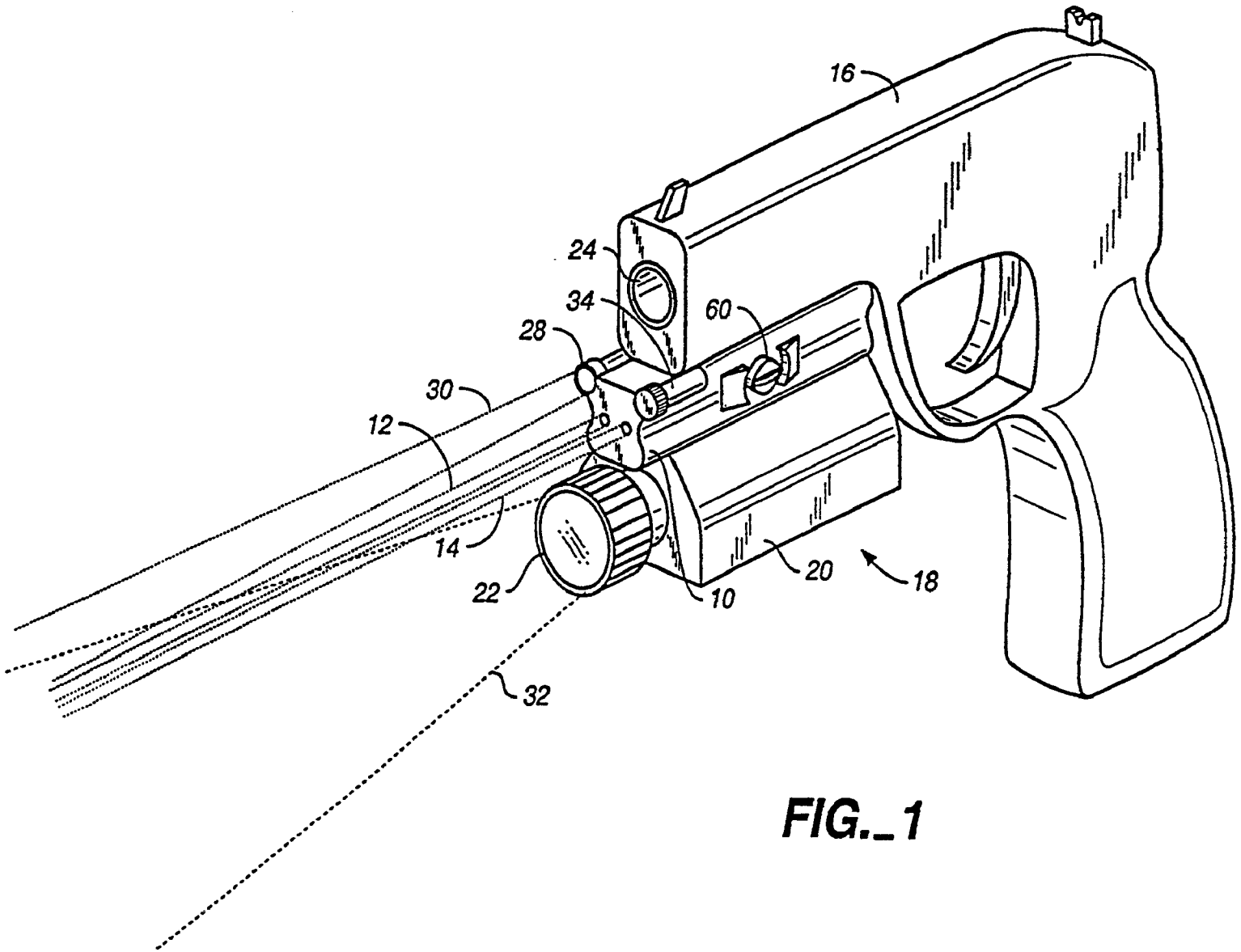
FIG. 1 is an isometric schematic view of a dual-beam laser aiming module and a tactical flashlight mounted to a generic handgun.

FIG. 1 illustrates a laser housing assembly 10 that provides dual laser beams, including an infrared (IR) beam 12 and a visible beam 14. The laser housing assembly 10 is adapted to be attached to a frame of a particular firearm, such as, for example, a handgun 16 using a corresponding slide mounting kit. A universal flashlight housing assembly 18 is appropriately mounted to the lower side of the laser housing 10 and includes a battery compartment 20 and a tactical light head 22. The beams 12, 14 are both initially aligned to be parallel to each other and subsequently the two parallel beams are aligned to be parallel to a centerline of a gun barrel 24 of the handgun 16 or firearm, such as a rifle. A light-emitting diode (LED) illuminator 28 provides a supplemental illumination beam 30 for use with night vision goggles sufficient to light up a 10 by 10 meter room. The tactical flashlight assembly 18 provides a beam 32 that can be focused or defocused by a user as required. An adjustment screwdriver tool 34 for adjusting elevation and windage adjustment screws is attached to the laser housing 10.

Figure 2:
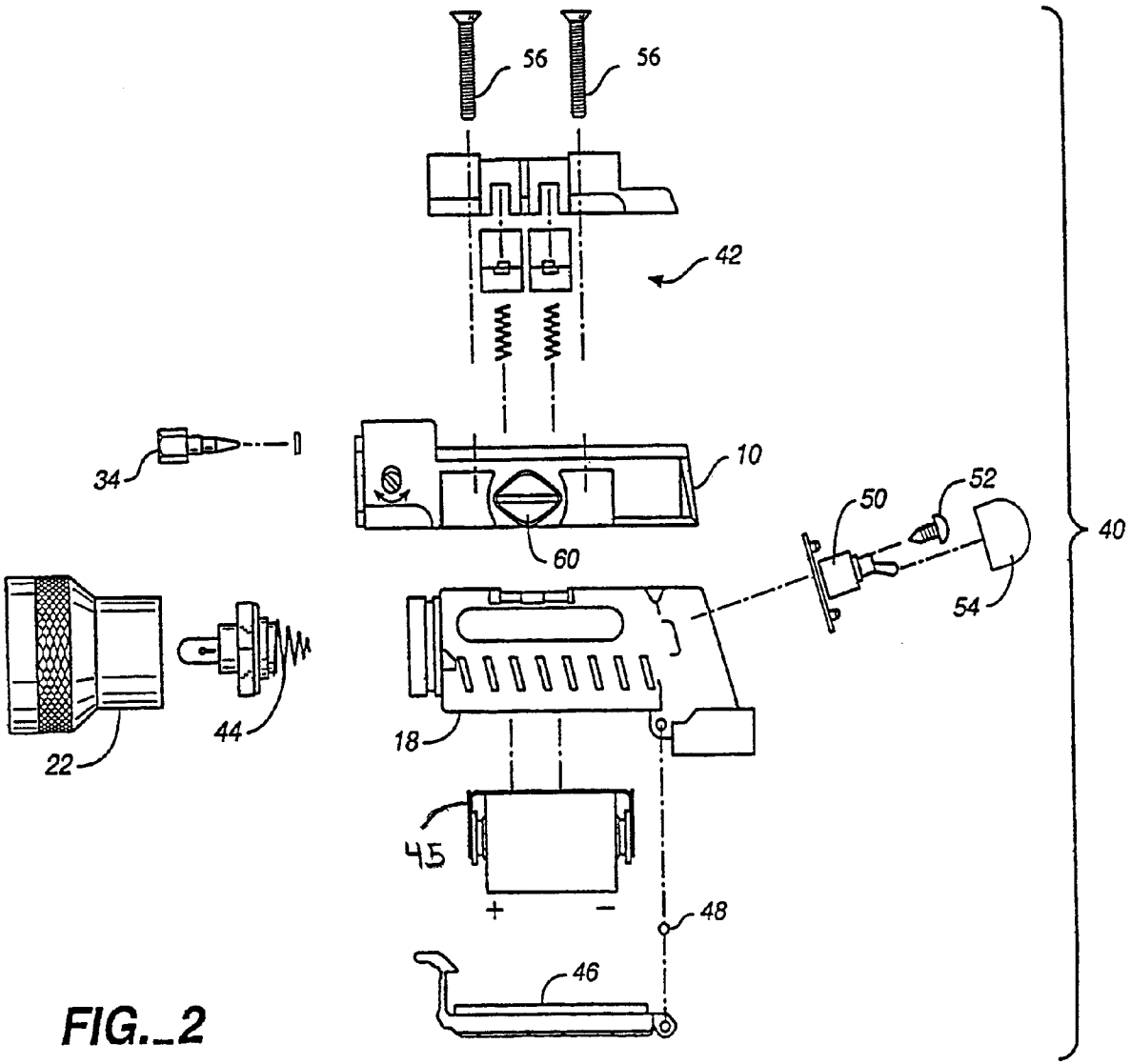
FIG. 2 is an exploded assembly view of the dual-beam laser aiming module with an attached tactical flashlight assembly.
Figure 3:
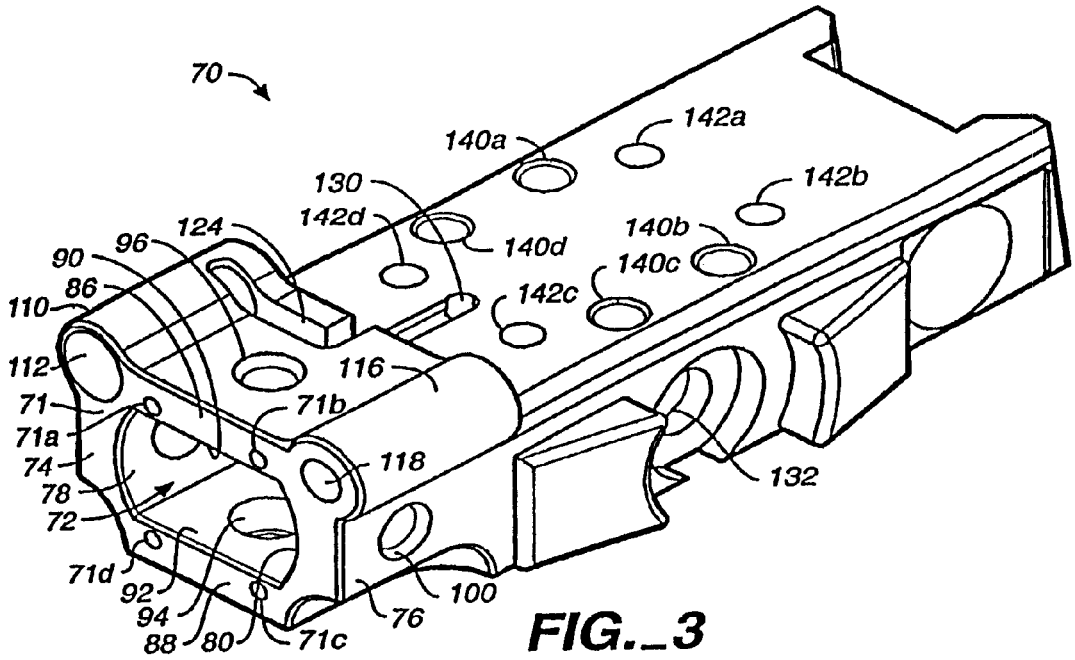
FIG. 3 is an isometric top view of a laser housing for the dual beam laser aiming module.
Figure 4:
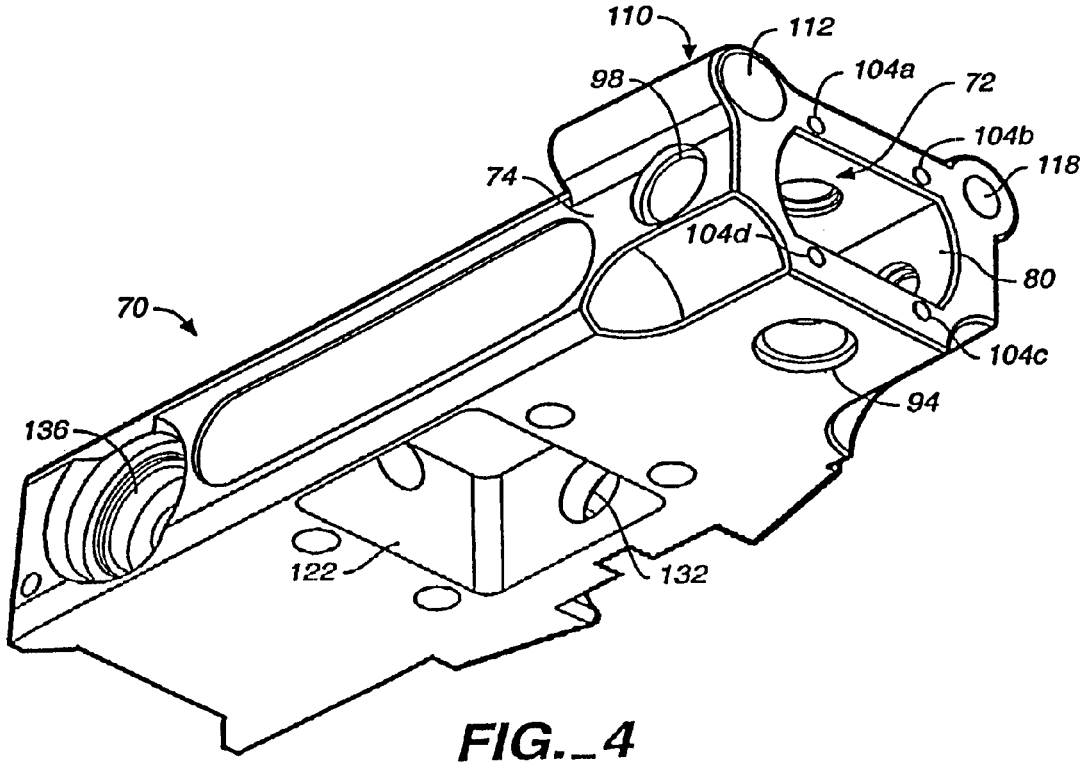
FIG. 4 is an isometric bottom view of the laser housing for the dual beam laser aiming module.

FIG. 2 illustrates the laser components of a multi-operational laser aiming device (MOLAD) 40 that includes: the laser housing assembly 10, a slide mounting kit 42, the universal flashlight housing assembly 18 with a bulb assembly 44 and the tactical light head 22, the battery compartment 20, a battery holder 45, a battery cover assembly 46, a screw 48 for the battery cover 46, the adjustment screwdriver tool 34, a circuit board and switch assembly 50 with a mounting screw 52 and a toggle switch cover 54. Four screws attach the laser housing assembly 10, with the slide mounting kit 42 and the universal flashlight housing assembly 18.

FIGS. 1 and 2 both show a rotary switch knob 60 for a rotary switch that is mounted to the left side of the laser housing 10. The switch knob 60 is used to select one of several different modes of operation, including: no operation (KILL), tactical light only, tactical light and laser only, and laser only. A toggle switch, not shown in FIGS. 1 and 2, is mounted to the right side of the laser housing 10 for selecting operation of either the infrared (IR) beam 12 or the visible beam 14 when laser operation is selected with the rotary switch knob 60.

FIGS. 3, 4, 5, 5A, 5B are referenced to illustrate details of the construction of a laser housing 70 for the laser housing assembly 10 that provides the dual laser beam. The laser housing 70 is formed as an elongated block of Delrin® Acetal engineering plastic material that has excellent machining characteristics and low moisture absorption, making it suitable for tight tolerance applications, high moisture or submerged applications, as well as bearing applications.

A flat front end face 71 of the laser housing 70 has four threaded holes 71*a*-71*d* formed therein. The front end 71 also has a cavity 72 formed therein. The cavity 72 is formed between a right side wall 74 and a left side wall 76, both of which have respective interior surfaces 78, 80 that are segments of cylinders. A far interior wall of the cavity 72 has a surface 84 that is formed as a segment of a sphere. A top wall 86 and a bottom wall 88 near the front of the laser housing 70 have respective flat interior surfaces 90, 92 that define the cavity 72.

The bottom wall 88 also has a threaded aperture 94 formed therethrough with an exterior countersunk. The top wall 86 also has a threaded aperture 96 formed therethrough. The right side wall 74 has a threaded aperture 98 formed therethrough with an exterior countersunk. The left side wall 76 has a threaded aperture 100 formed therethrough.

An enlarged upper right, front corner projection 110 of the laser, housing 70 had a cavity 112 formed therein from the front face 74. An enlarged upper left, front corner projection 116 of the laser housing 12 has a threaded cavity 118 formed therein for carrying the adjustment screwdriver tool 34 that is used for making elevation and windage adjustments.

Various provisions are made for routing electrical wires through the laser housing 70. A center bore 120 is formed through the center of the far interior wall 82 of the cavity 72, to a square cavity 122 that is formed through the bottom of the laser housing 70, and through the rear portion of the laser housing 70. A depressed wire channel 124 is formed into the exterior surface of the top wall 86 to connect the interior end of the cavity 112 to a vertical bore 130 that intersects the center bore 120, which is formed through the center of the far interior wall 82 of the cavity 72.

Near the back end of the laser housing 70 is a larger bore 134 that extends through the left exterior sidewall 76 and into the back portion of the laser housing 12. A concentric smaller bore 136 with two exterior countersunk bores extends from the larger bore 94 to the right exterior side wall 74.

Extending through the top central surface of the laser housing 12 are four bore holes 140*a*-140*d* used to engage one end of four spiral springs for the slide mounting kit 42 of FIG. 2. Four through holes 142*a*-142*d* extend into the top central surface, through the laser housing 12, and out of a flat, bottom surface 88 of the laser housing 12 for the four screws 50 to attach together the laser housing assembly 10 with the slide mounting kit 42 and with the universal flashlight housing assembly 18.

Extending through the left exterior side wall 76 and into the square cavity 122 is a through hole 132 with an exterior countersunk.

Figure 6C:
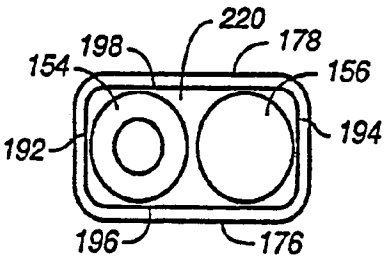
FIG. 6C is an end view of a dual-laser alignment assembly.
Figure 6B:
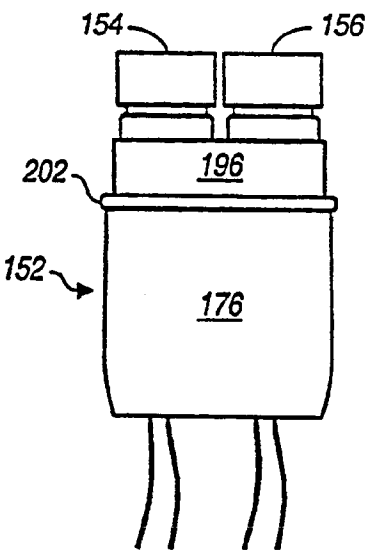
FIG. 6B is an assembled view of a dual-laser alignment assembly with an O-ring.
Figure 6A:
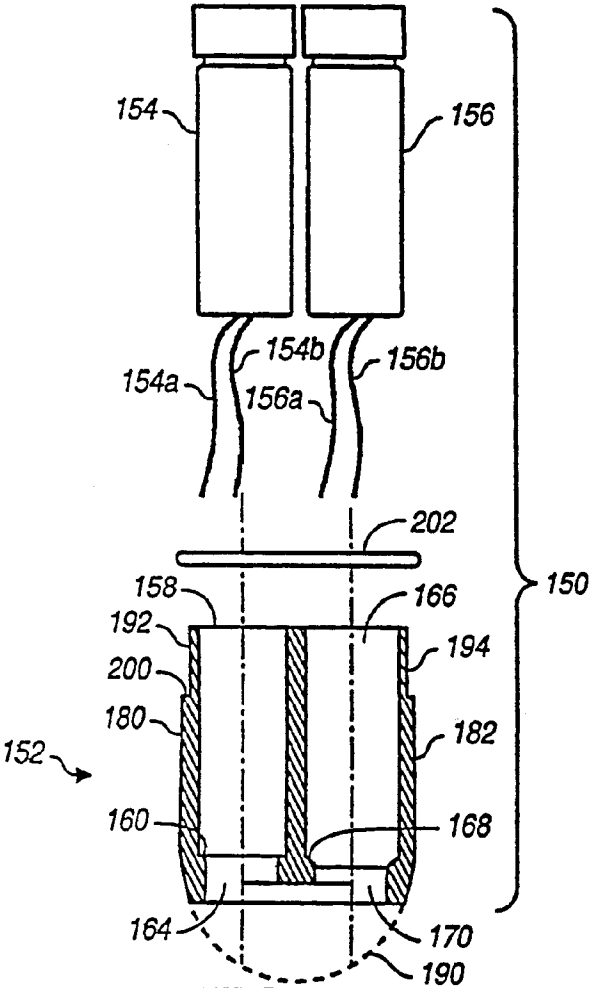
FIG. 6A is an exploded, partially sectional view of components of a dual-laser alignment assembly.

FIG. 6A-6C illustrate the components of a dual-laser alignment assembly 150. A dual-laser alignment housing 152 is provided for aligning, for example, a first cylindrical infrared (IR) laser assembly 154 with a second cylindrical (visible) laser assembly 156. The first cylindrical infrared (IR) laser assembly 154 is press-fit into a first bore 158 that has a square bottom shoulder 160 that is formed with a counter bore 164 so that the bottom outer edge of the laser assembly 154 engages the square bottom shoulder 160. A pair of power wires 154*a*, 154*b* for the laser assembly 154 extend from the bottom end of the laser assembly 150 and through the counter bore 164.

The second cylindrical (visible) laser assembly 156 is loosely contained in a second bore 166 that has an oblique, chamfered bottom shoulder 168 that is formed with a counter bore 170 and that is chamfered at forty-five degrees. The bottom outer edge of the cylindrical laser assembly 156 engages the chamfered, oblique bottom shoulder 164. The second cylindrical (visible) laser assembly 156 fits loosely in the second bore 166 to accommodate pivoting of the second cylindrical (visible) laser assembly 156 on the chamfered, oblique bottom shoulder 168. A pair of power wires 156*a*, 156*b* for the laser assembly 156 extend from the bottom end of the laser assembly 150 and through the counter bore 170.

In this particular embodiment of the invention, the dual-laser alignment housing 152 is formed of brass and serves as a heat-sink for the first and second laser assemblies 154, 156. A lower part of the dual-laser alignment housing 152 has flat front and rear exterior walls 176,178. Lower side walls 180, 182 of the dual-laser alignment housing 152 are tapered two degrees to be narrower towards its top end. The bottom end of the dual-laser alignment housing 152 has a, spherical contour that has a radius as indicated by the dashed line 190 and that is truncated by the front and rear exterior walls 176, 178. The spherical contour of the bottom end of the dual-laser alignment housing conforms to the spherical segment surface 84 of the far interior wall 82 of the cavity.

A generally rectangular upper part of the dual-laser alignment housing 152 has vertical flat side walls 192, 194 and flat front and rear walls 196, 198. The rectangular upper part 192 of the dual-laser alignment housing 152 is somewhat smaller than the lower part so that a shoulder 200 is formed at the junction of the two parts of the housing 152. The dual laser alignment assembly includes an O-ring 202 positioned on the shoulder 200.

Figure 7:
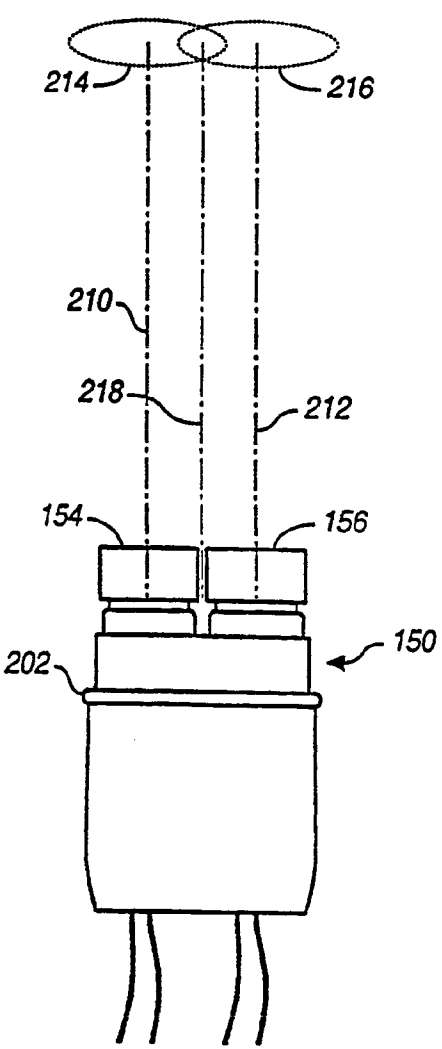
FIG. 7 illustrates parallel alignment of two laser modules in dual-laser alignment assembly

FIG. 7 illustrates parallel alignment of the infrared (IR) laser beam 12 and the visible laser beam 14. The IR beam 12 has a beam axis 210 and the visible laser beam 14 has a beam axis 212. Parallel alignment of these two laser beams is obtained by properly assembling and aligning the infrared (IR) laser assembly 154 and the visible laser assembly 156 in the dual-laser alignment housing 152. When the axes 210, 212 of the two beams are properly aligned, FIG. 7 illustrates that the respective circular beam patterns 214, 216 intersect each other at a distance of, for example, 25 meters. The description to follow is concerned only with parallel alignment of the beams 210, 212. For reference, an axis 218 of a gun barrel is also shown. Alignment of the parallel beams 210, 212 with the axis 218 of a gun barrel is described subsequently.

The dual-laser alignment assembly 150 includes, for example, the infrared (IR) laser assembly 154 and the visible laser assembly 156 both of which are assembled into the dual-laser alignment housing 152 to provide parallel beams. The first cylindrical infrared (IR) laser assembly 154 is press-fit into the first bore 158 in the dual-laser alignment housing 152 to establish orientation of the IR beam axis 210 in the dual-laser alignment housing 152. The second (visible) laser assembly 156 is loosely contained in the second bore 166 with the lower end of the laser assembly pivoting on the chamfered, oblique bottom shoulder 168 at the bottom of the second bore 166 in the dual-laser alignment housing 152. The second cylindrical (visible) laser assembly 156 is pivoted on the oblique, chamfered bottom shoulder 168 to align the axis 212 of the visible beam 212 in parallel with the axis 210 of the IR beam as indicated in FIG. 7. The second cylindrical (visible) laser assembly 156 is then fixed in a parallel position with an adhesive material 220 such that the axis 212 of the second visible beam is fixed to be parallel to the axis 210 of the first IR beam.

Figure 8:
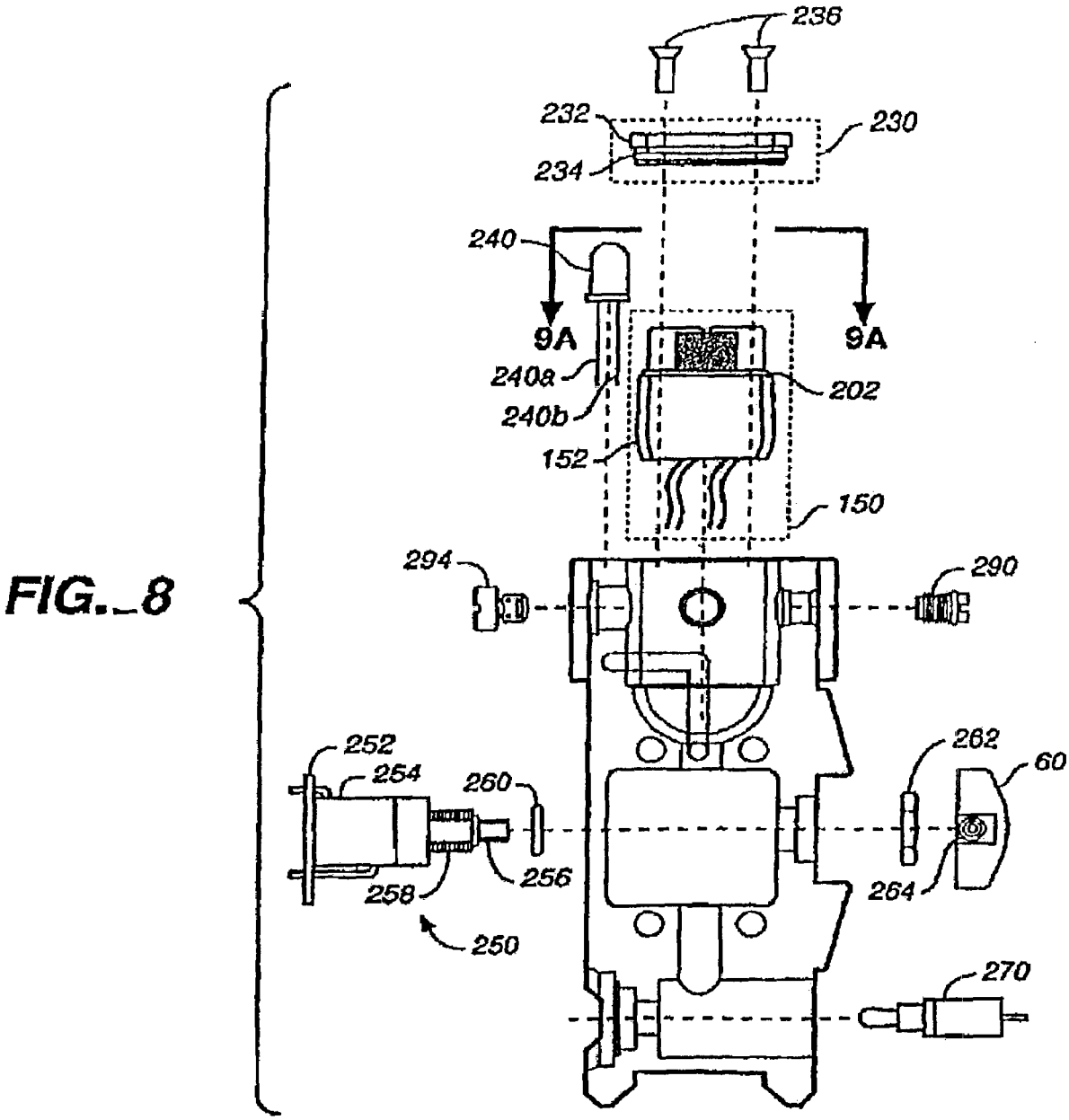
FIG. 8 is an exploded plan assembly view of the dual beam laser aiming module.

FIG. 8 illustrates assembly of various components into the laser housing 12 to provide the dual beam laser aiming module 10.

A front window assembly 230 includes a window lens 232 and an O-ring 234 that are mounted to the flat front end 71 of the laser housing 12 with four flat-head screws (typically shown as 236) that are screwed into the respective four smaller threaded holes 71*a*-71*d* in the flat front face 71 of the laser housing 70. The front window assembly 230 covers the dual-laser alignment assembly 150 that is contained within the cavity 72 formed in the front end of the laser housing 12. An LED 880 nM. IR emitter 240 is fixed in the bore 112 through the flat, front face 71. Power wires 240*a*, 240*b* for the IR emitter 240 extend through the laser housing 12 and into the square cavity 122.

A printed circuit board assembly 250 includes a circuit board 252 that has attached to it various power wires and a rotary switch assembly 254. The circuit board assembly 250 is contained in the square cavity 122 that is formed through the bottom surface of the laser housing 12. A rotary shaft 256 with a flatted end turns within a concentric externally threaded barrel 258 of the rotary switch assembly 254 extend through an O-ring 230 and through the hole 92 in the laser housing 12. The printed circuit board assembly 250 is attached to the laser housing with a nut 262 that is threaded to the externally threaded barrel 258 of the rotary switch assembly 250. The rotary switch knob 60 is fixed to the flatted end of the rotary shaft with a set screw 264 in the rotary switch knob 60. The rotary switch is rotated with the switch knob 60 to select one of several different modes of operation, including: no operation (KILL), tactical light only, tactical light and laser only, and laser only.

FIG. 8 shows a toggle switch 270, not shown in FIGS. 1 and 2, that is mounted to the right side of the laser housing 12 for selecting operation of either the infrared (IR) beam 12 or the visible beam 14 when a laser operation is selected with the rotary switch knob 60.

Figure 5B:
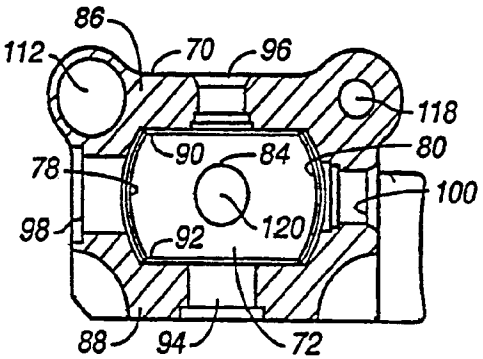
FIG. 5B is a front sectional view taken along line 5B-5B of FIG. 5.
Figure 5:
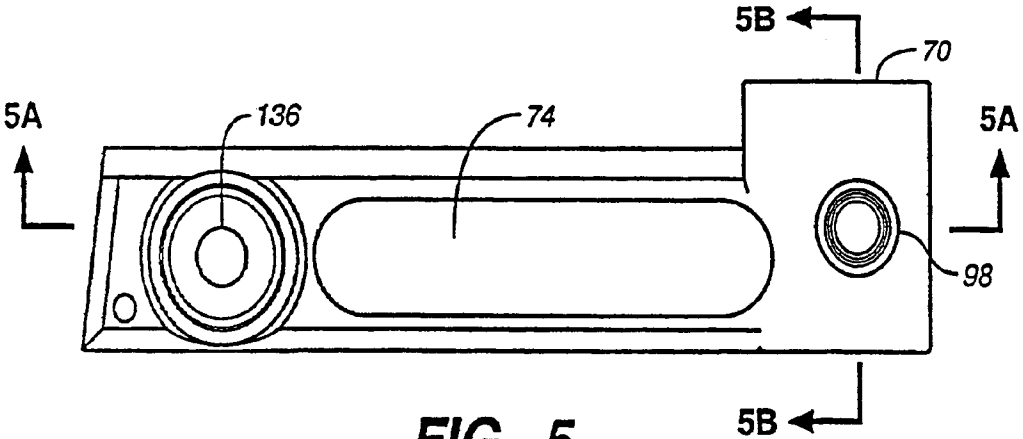
FIG. 5 is a side elevation view of the laser housing for the dual beam laser aiming module.
Figure 5A:
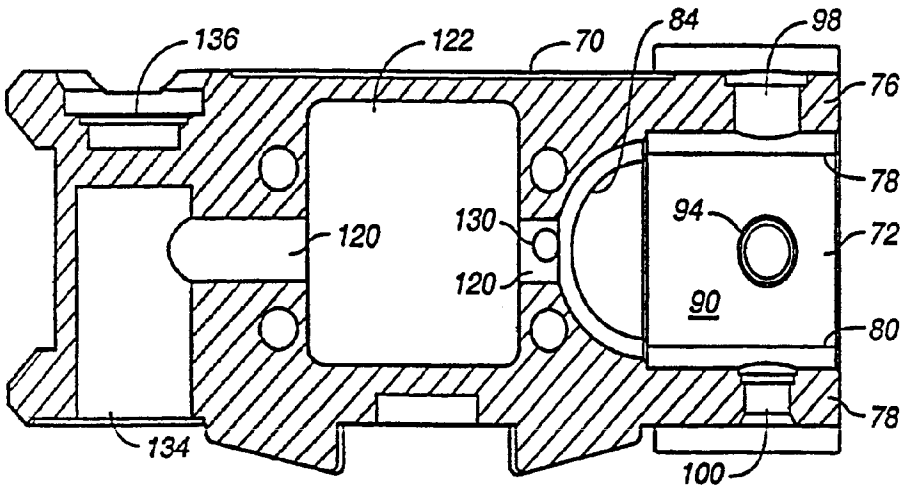
FIG. 5A is a sectional view taken along line 5A-5A of FIG. 5.
Figure 9A:
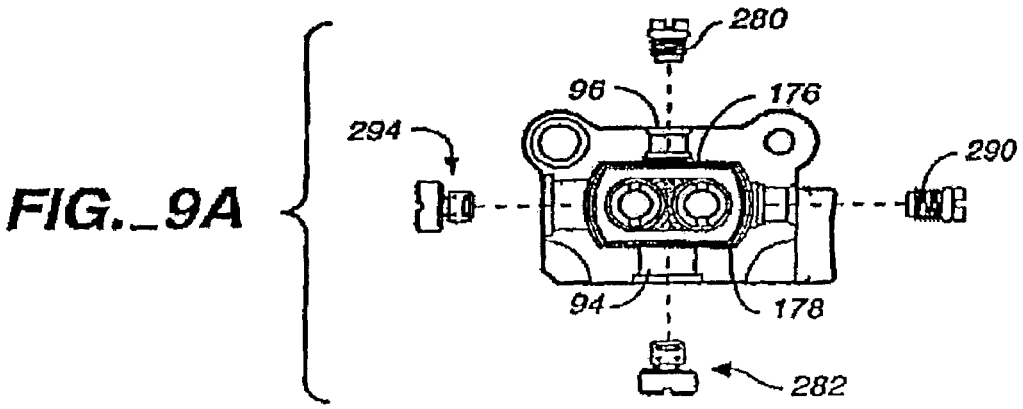
FIGS. 9A and 9B show a partially exploded assembly view illustrating the adjustment screws and corresponding biasing assemblies for adjustable alignment of a dual laser alignment assembly in the laser housing.

FIG. 9A illustrates the dual laser alignment assembly 152 mounted inside the cavity 72 of the laser housing 70 for adjustment of elevation and windage. As shown in FIG. 5B, the far interior wall of the cavity 72 has a surface 84 that is formed as a segment of a sphere. As shown in FIG. 6A. the bottom end of the dual-laser alignment housing 152 has a similar spherical contour that has a radius as indicated by the dashed line 190. The lower side walls 180, 182 of the dual-laser alignment housing 152 are tapered two degrees to be narrower towards its top end. This arrangement allows the dual-laser alignment housing 152 to pivot somewhat within the laser housing 12 to thereby allow the parallel IR and visible beams to be further aligned in parallel with the axis of the gun barrel 218, as illustrated in FIG. 7.

Figure 9B:
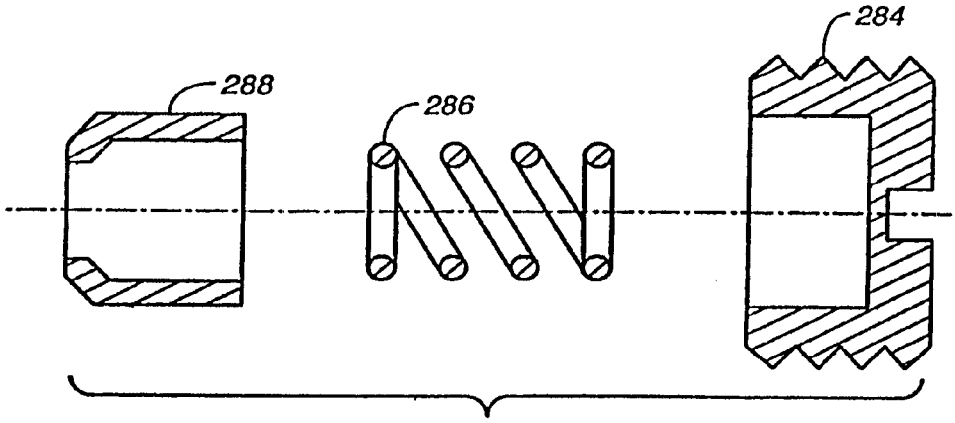

An elevation adjustment screw 280 is threaded into the threaded aperture 96 formed through the top wall 86 of the laser housing 12. An end of the elevation adjustment screw 280 contacts the flat rear wall 198 of the upper part of the dual-laser alignment housing 152. Pushing against the opposite wall 196 of the upper part of the dual-laser alignment housing 152 is a biasing assembly in the form of a pocket screw and plunger assembly 282. FIG. 9B shows this type of assembly 282 as a pocket screw 284, a coil spring 286, and a cup-shaped bushing, or plunger tip, 288. The plunger tip 288 is biased by one end of the coil spring 286 against the wall 196 of the upper part of the dual-laser alignment housing 152 The other end of the coil spring 286 contacts an interior pocket of the pocket screw 284 that has external threads that engage corresponding threads in the threaded aperture 94 formed in the bottom wall 56 of the laser housing 70.

Similarly, a windage adjustment screw 290 is threaded into the threaded aperture 98 formed through the side 74 of the laser housing 70. An end of the windage adjustment screw 290 contacts the flat side wall 192 of the upper part of the dual-laser alignment housing 152. Pushing against the opposite side wall 194 of the upper part of the dual-laser alignment housing 152 is another biasing assembly 294 in the form of another pocket screw and plunger assembly 294. This arrangement provides an adjustable four-point alignment mechanism for adjustment of the position of the dual-laser alignment housing to thereby align the parallel IR and visible laser beams to both be parallel to the axis of a firearm, such as handgun or rifle.

The rectangular upper part 192 of the dual-laser alignment housing 152 is somewhat smaller than the lower part so that a shoulder 200 is formed at the junction of the two parts of the housing 152 so that the O-ring 202 is positioned on the shoulder 200. The O-ring has a durometer of 50-70 and is compressed somewhat by engagement with Note that the sides of the tips of the adjustment screws 280, 290 as well as the sides of the tips of the bushings of the biasing assemblies 282, 294 bear against the O-ring 202 to compress the O-ring 202 approximately 10 to 20 percent. This provides friction loading on the ends of the adjustment screws. This also provides a certain amount of rigidity of alignment for the dual-laser alignment housing 152. This is particularly important during shock conditions such as when the gun is fired. This arrangement reduces forward longitudinal movement of the dual-laser alignment housing 152 in a direction parallel to the axis of the gun barrel. This arrangement prevents forward movement of the dual-laser alignment housing 152 and disengagement of the dual-laser alignment housing 152 from the spherical pivot surface 82 in the laser housing 70.

Figure 10:
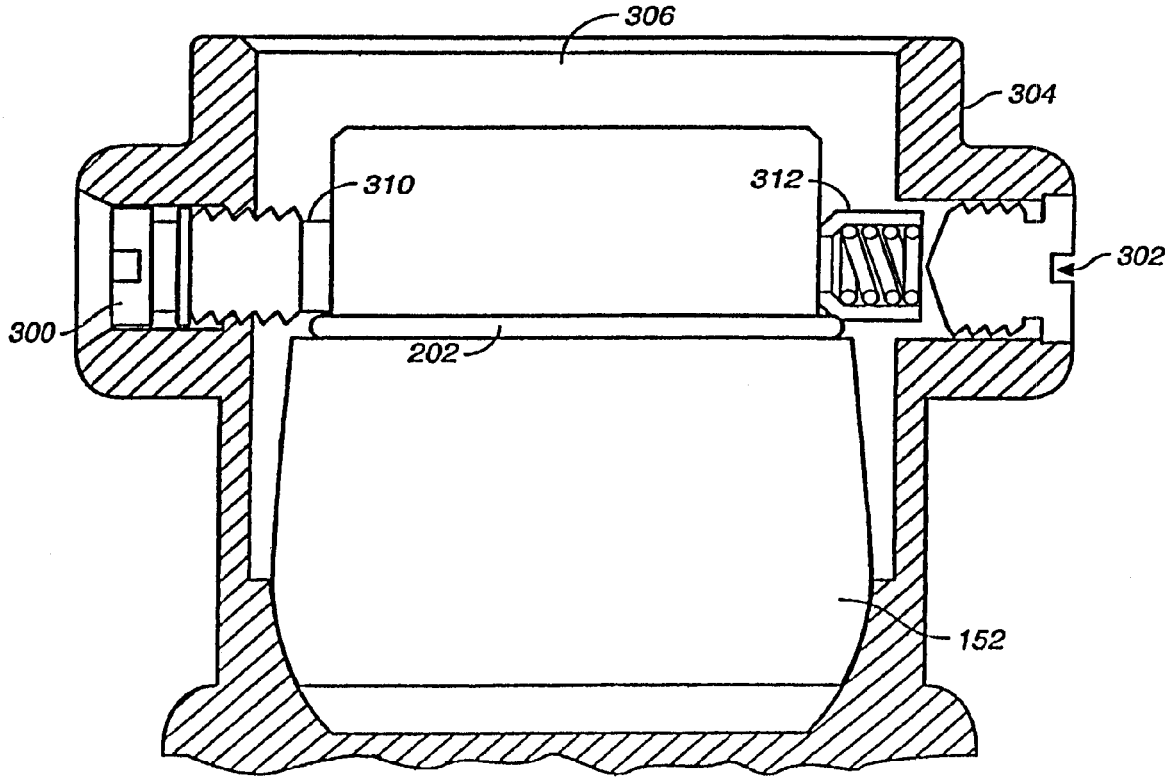
FIG. 10 is a partially sectional view, assembly view illustrating an alternative adjustment screw and biasing assembly in a slightly modified alternative laser housing.

FIG. 10 illustrates an alternative adjustment screw 300 and a biasing assembly 302 in an alternative laser housing 304. This arrangement is similar to that of FIG. 9A. The same dual-laser housing 152 is contained within a cavity 306 formed in the laser housing 304. The O-ring 202 is positioned on the shoulder 200 of the dual-laser housing 152. An unthreaded, smooth side surface 310 at the lower end of the adjustment screw 300 as well as a bushing 312 of the biasing assembly 302 both contact the forward side of the O-ring 202 and compress the O-ring 202 to provide a certain amount of rigidity to a dual-laser alignment housing 152 in the laser housing 304. This provides a certain amount of friction loading on the ends of the adjustment screws and biasing assemblies. This also provides a certain amount of rigidity of alignment for the dual-laser alignment housing 152, particularly during shock conditions, such as, for example, when the gun is fired. This arrangement reduces forward longitudinal movement of the dual-laser alignment housing 152 in a direction parallel to the axis of the gun barrel. This arrangement prevents excessive forward movement of the dual-laser alignment housing 152 and disengagement of the dual-laser alignment housing 152 from a spherical pivot surface in the laser housing 304.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

I claim:

1. A dual beam laser aiming module for a firearm comprising:

a dual-laser alignment housing having a first cavity and a second cavity formed therein;

a first laser assembly that is fixed in the first cavity and that has a first beam axis;

a second laser assembly that has a second beam axis and that is adjustably located in the second cavity to provide the second beam axis substantially parallel to the first beam axis;

a laser housing adapted to be fixed to the firearm and having a cavity formed therein for receiving the dual-laser alignment housing, wherein the dual-laser alignment housing has a rounded exterior surface that interfaces with a corresponding rounded surface in the interior of the cavity of the laser housing; and an adjustment mechanism for adjustably pivoting the dual-laser alignment housing with respect to the laser housing to align the substantially parallel first and second axes further substantially parallel to a centerline of a barrel of the firearm, the adjustment mechanism for adjustably pivoting the dual-laser alignment housing with respect to the laser housing comprising a four-point laser alignment mechanism for adjustably pivoting the dual-laser alignment housing with respect to the laser housing to align the substantially parallel first and second axes substantially parallel to the centerline of the barrel of the firearm, wherein the four-point laser alignment mechanism includes:

a first adjustment screw, an end of which contacts the dual-laser alignment housing and which is aligned for movement in a first direction, the first direction being substantially perpendicular to the centerline of the barrel;

a second adjustment screw, an end of which contacts the dual-laser alignment housing and which is aligned for movement in a second direction, the second direction being substantially perpendicular to the centerline of the barrel and substantially orthogonal to the first direction of the first adjustment screw; and two spring-loaded bushings that bias the dual-laser alignment housing against a respective end of the first and the second adjustment screws.

2. The dual-beam laser aiming module of claim 1 wherein the dual-laser alignment housing is fitted with an O-ring such that unthreaded side surfaces near the ends of the first and second adjustment screws and side surfaces of the spring-loaded bushings all contact and compress the O-ring to stabilize the position of the dual-laser alignment housing and to attenuate longitudinal movement of the dual-beam alignment housing in the direction of the beam axes.

3. The dual beam laser aiming module of claim 2 wherein the first laser assembly provides an infrared beam.

4. The dual beam laser aiming module of claim 2 wherein the second laser assembly provides a visible beam.

5. The dual beam laser aiming module of claim 1 wherein the laser housing includes a LED IR illuminator adapted for use with night vision goggles.

6. The dual beam laser aiming module of claim 1 including a toggle switch mounted to the laser housing for selecting exclusive operation of either the first laser assembly or of the second laser assembly.

7. The dual beam laser aiming module of claim 1 wherein the laser housing is adapted to be attached to a particular firearm with a corresponding mounting base for the laser housing.

8. The dual beam laser aiming module of claim 1 wherein the laser housing has a tactical flashlight assembly mounted thereto to provide a multi-operational laser aiming module having both laser and flashlight capabilities.

9. The dual beam laser aiming module of claim 8 including a rotary switch mounted to the laser housing for selecting operation selected from the group consisting of: no operation, a tactical light only, the tactical light and a laser only, and a laser only.

10. A dual beam laser aiming module for a firearm comprising:

a dual-laser alignment housing having a first cavity and a second cavity formed therein;

a first laser assembly that is fixed in the first cavity and that has a first beam axis;

a second laser assembly that has a second beam axis and that is adjustably located in the second cavity to provide the second beam axis substantially parallel to the first beam axis;

a laser housing adapted to be fixed to the firearm and having a cavity formed therein for receiving the dual-laser alignment housing, wherein the dual-laser alignment housing has a rounded exterior surface that interfaces with a corresponding rounded surface in the interior of the cavity of the laser housing; and an adjustment mechanism for adjustably pivoting the dual-laser alignment housing with respect to the laser housing to align the substantially parallel first and second axes further substantially parallel to a centerline of a barrel of the firearm, the adjustment mechanism for adjustably pivoting the dual-laser alignment housing with respect to the laser housing comprising a four-point laser alignment mechanism for adjustably pivoting the dual-laser alignment housing with respect to the laser housing to align the substantially parallel first and second axes substantially parallel to the centerline of the barrel of the firearm, wherein the first laser assembly is press-fit into the first cavity; and the second laser assembly is adjusted to a fixed position in the second cavity with an adhesive material such that the axis of the second beam is fixed to be substantially parallel to the axis of the first beam.

11. A dual beam laser aiming module for a firearm comprising:

a dual-laser alignment housing having a first cavity and a second cavity formed therein;

a first laser assembly that is fixed in the first cavity and that has a first infrared (IR) laser beam with a first beam axis;

a second laser assembly that has a second visible laser beam with a second beam axis and that is adjustably located in the second cavity to provide the second beam axis substantially parallel to the first beam axis;

a laser housing adapted to be fixed to the firearm and having a cavity formed therein for receiving the dual-laser alignment housing, wherein the dual-laser alignment housing has a rounded exterior surface that interfaces with a corresponding rounded surface in the interior of the cavity of the laser housing; and a four-point laser alignment mechanism for adjustably pivoting the dual-laser alignment housing with respect to the laser housing to align the substantially parallel first and second axes substantially parallel to the centerline of the barrel of the firearm, wherein the four-point laser alignment mechanism includes:

a first adjustment screw, an end of which contacts the dual-laser alignment housing and which is aligned for movement in a first direction, the first direction being substantially perpendicular to the centerline of the gun barrel;

a second adjustment screw, an end of which contacts the dual-laser alignment housing and which is aligned for movement in a second direction, the second direction being substantially perpendicular to the centerline of the barrel and substantially orthogonal to the first direction of the first adjustment screw; and two spring-loaded bushings that bias the dual-laser alignment housing against a respective end of the first and the second adjustment screws.

12. A dual beam laser aiming module for a firearm comprising:

a dual-laser alignment housing having a first cavity and a second cavity formed therein;

a first laser assembly that is fixed in the first cavity and that has a first infrared (IR) laser beam with a first beam axis;

a second laser assembly that has a second visible laser beam with a second beam axis and that is adjustably located in the second cavity to provide the second beam axis substantially parallel to the first beam axis;

a laser housing adapted to be fixed to the firearm and having a cavity formed therein for receiving the dual-laser alignment housing, wherein the dual-laser alignment housing has a rounded exterior surface that interfaces with a corresponding rounded surface in the interior of the cavity of the laser housing; and a four-point laser alignment mechanism for adjustably pivoting the dual-laser alignment housing with respect to the laser housing to align the substantially parallel first and second axes substantially parallel to the centerline of the barrel of the firearm, wherein the first IR laser assembly is press-fit into the first cavity; and the second visible laser assembly is adjusted to a fixed position in the second cavity with an adhesive material such that the axis of the second beam is fixed to be substantially parallel to the axis of the first beam.

13. A dual beam laser aiming module for a firearm comprising:

a dual-laser alignment housing having a first cavity and a second cavity formed therein;

a first laser assembly that is fixed in the first cavity and that has a first infrared (IR) laser beam with a first beam axis;

a second laser assembly that has a second visible laser beam with a second beam axis and that is adjustably located in the second cavity to provide the second beam axis substantially parallel to the first beam axis;

a laser housing adapted to be fixed to the firearm and having a cavity formed therein for receiving the dual-laser alignment housing, wherein the dual-laser alignment housing has a rounded exterior surface that interfaces with a corresponding rounded surface in the interior of the cavity of the laser housing; and a four-point laser alignment mechanism for adjustably pivoting the dual-laser alignment housing with respect to the laser housing to align the substantially parallel first and second axes substantially parallel to the centerline of the barrel of the firearm, wherein;

the laser housing has a tactical flashlight assembly mounted thereto to provide a multi-operational laser aiming module having both laser and flashlight capabilities and, further wherein;

the dual beam laser aiming module includes a rotary switch mounted to the laser housing for selecting operation selected from the group consisting of: no operation, the tactical light only, the tactical light and a laser only.

14. A method of aiming a firearm comprising:

providing a dual-laser alignment housing having a first cavity and a second cavity formed therein;

fixing a first laser assembly that has a first beam axis in the first cavity;

adjusting and fixing a second laser assembly that has a second beam axis in the second cavity and providing the second beam axis substantially parallel to the first beam axis;

providing a cavity in a laser housing for receiving the dual-laser alignment housing and adapting the laser housing to be fixed to the firearm;

providing the dual-laser alignment housing with a rounded exterior surface and interfacing the rounded exterior surface with a corresponding rounded surface in the interior of the cavity of the laser housing; and adjustably pivoting the dual-laser alignment housing with respect to the laser housing for aligning the substantially parallel first and second axes further substantially parallel to a centerline of a barrel of the firearm with a four-point laser alignment mechanism, wherein adjustably pivoting the dual-laser alignment housing with respect to the laser housing and aligning the substantially parallel first and second axes substantially parallel to the centerline of the barrel of the firearm with a four-point laser alignment mechanism includes:

contacting the dual-laser alignment housing with an end of a first adjustment screw, an end of which contacts the dual-laser alignment housing and which is aligned for movement in a first direction, the first direction being substantially perpendicular to the centerline of the barrel;

contacting the dual-laser alignment housing with an end of a second adjustment screw, an end of which contacts the dual-laser alignment housing and which is aligned for movement in a second direction, the second direction being substantially perpendicular to the centerline of the barrel and substantially orthogonal to the first direction of the first adjustment screw; and biasing the dual-laser alignment housing against a respective end of the first and the second adjustment screws with two respective spring-loaded bushings.

15. The method of claim 14 including fitting the dual laser alignment housing with an O-ring such that the O-ring is in contact with respective unthreaded side surfaces near the ends of the first and second adjustment screws and side surfaces of the spring-loaded bushings, and compressing the O-ring to stabilize the position of the dual-laser alignment housing in order to attenuate longitudinal movement of the dual-laser alignment housing in the direction of the beam axes.

16. The method of claim 14 including press-fitting the first laser assembly into the first cavity; and adjusting and fixing the second laser assembly to a fixed position in the second cavity with an adhesive material such that the axis of the second beam is fixed to be substantially parallel to the axis of the first beam.

17. The method of claim 14 including illuminating an area with an LED IR illuminator adapted for use with night vision goggles.

18. The method of claim 14 including exclusively operating either the first laser assembly or the second laser assembly with a toggle switch mounted to the laser housing.

19. The method of claim 14 including a particular firearm with a corresponding mounting base for the laser housing.

20. The method of claim 14 including mounting a tactical flashlight to the laser housing to provide a multi-operational laser aiming module having both laser and flashlight capabilities.

21. The method of claim 20 including selecting with a rotary switch mounted to the laser housing an operation selected from the group consisting of: no operation, a tactical light only, the tactical light and a laser only, and a laser only.

22. The dual beam laser aiming module of claim 14 wherein the first laser assembly provides an infrared beam.

23. The dual beam laser aiming module of claim 14 wherein the second laser assembly provides a visible beam.

* * * * *